US007356893B2

(12) United States Patent
Bachmann

(10) Patent No.: US 7,356,893 B2
(45) Date of Patent: Apr. 15, 2008

(54) DEVICE FOR THE SEPARATION OF THREADS FROM A THREAD LAYER

(75) Inventor: Walter Bachmann, Rüschlikon (CH)

(73) Assignee: Stäubli ag Pfäffikon, Pfäffikon (CH)

( * ) Notice: Subject to any disclaimer, the term of this patent is extended or adjusted under 35 U.S.C. 154(b) by 592 days.

(21) Appl. No.: 10/901,095

(22) Filed: Jul. 29, 2004

(65) Prior Publication Data

US 2005/0028335 A1 Feb. 10, 2005

Related U.S. Application Data

(63) Continuation-in-part of application No. PCT/CH03/00058, filed on Jan. 24, 2003.

(51) Int. Cl.
*B65H 75/00* (2006.01)

(52) U.S. Cl. ..... 28/198; 28/202; 28/203.1; 28/185

(58) Field of Classification Search ..... 28/202, 28/203.1, 198, 172.2, 172.1, 184, 185–187, 28/205, 194, 195, 190, 193
See application file for complete search history.

(56) References Cited

U.S. PATENT DOCUMENTS

| | | | | |
|---|---|---|---|---|
| 1,147,413 | A * | 7/1915 | Lea | 28/202 |
| 1,530,605 | A * | 3/1925 | Magnano | 28/202 |
| 1,550,246 | A * | 8/1925 | Entwistle et al. | 28/202 |
| 2,690,606 | A * | 10/1954 | Fleischer | 28/202 |
| 2,696,654 | A * | 12/1954 | Townsend | 28/203.1 |
| 2,907,092 | A * | 10/1959 | Altenweger | 28/202 |
| 3,136,025 | A * | 6/1964 | Noone et al. | 28/205 |
| 3,197,838 | A * | 8/1965 | Fauring | 28/202 |
| 4,164,805 | A * | 8/1979 | Altenweger | 28/202 |
| 4,545,099 | A | 10/1985 | Tovenrath et al. | |
| 5,099,555 | A * | 3/1992 | Okuda | 28/172.1 |

FOREIGN PATENT DOCUMENTS

| | | |
|---|---|---|
| DE | 28 47 520 | 5/1980 |
| DE | 36 24 981 | 2/1988 |
| EP | 0 725 171 | 8/1996 |
| GB | 568 744 | 4/1945 |
| GB | 718 251 | 11/1954 |

* cited by examiner

*Primary Examiner*—A. Vanatta
(74) *Attorney, Agent, or Firm*—Venable LLP

(57) ABSTRACT

In order, during the processing of a thread layer, which is tensioned in tensioning means and exhibits threads running parallel to one another, to be able to vary the sequence of the processing of the threads, a storage device is proposed for the temporary deposition of at least one of the threads which can be separated from a thread layer. The storage device is provided with at least one storage means, which exhibits at least one retaining means for the retention of one or more threads under tension, whereby the minimum of one retaining means is arranged outside the plane of the thread layer. In addition, the storage device exhibits at least one transfer means, with which the thread can be transferred to the storage means.

25 Claims, 15 Drawing Sheets

DEVICE FOR THE SEPARATION OF THREADS FROM A THREAD LAYER

Figure 1:
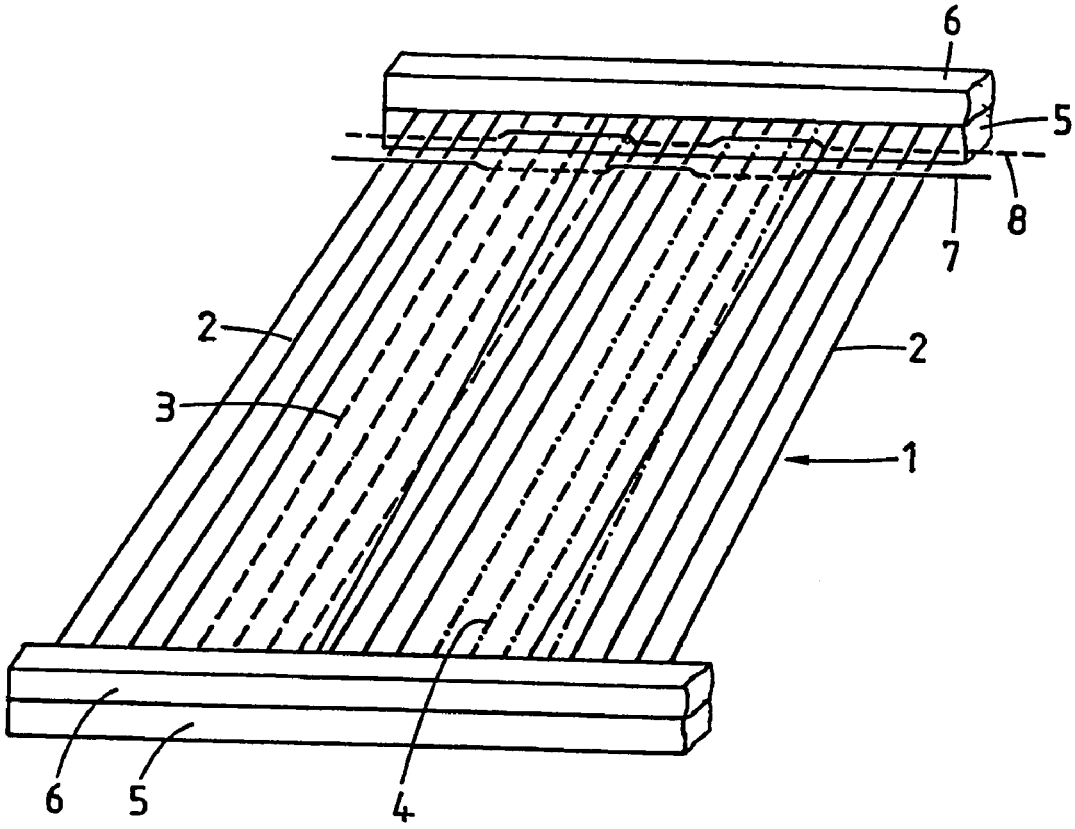

This application is a continuation-in-part of PCT/CH03/00058 filed Jan. 24, 2003, which claims priority to CH 159/02 filed Jan. 30, 2002, both of which are incorporated by reference herein.

The invention relates to a device for the separation of threads from a thread layer, which is tensioned between two tensioning points.

The division or separation of threads is an operational step which must be carried out frequently in the production of textile goods. Examples of this are the drawing in of warp threads or ends from a warp thread layer into the harness draft elements of a weaving loom or the crossing of a thread lease. A further application is derived from the linking of the warp threads of an old warp thread layer, already provided with weft threads, to a new warp thread layer. In this case too, warp ends are tensioned in a frame and, before knotting by the tying machine, must be separated from the layer.

In all these cases, the threads are present tensioned in a frame, in which together they form a thread layer. In this situation, the individual threads are usually located very close to one another, which renders separation difficult. The term "separation" can be understood in this case to mean a measure by means of which the individual threads of the layer are rendered capable of being handled for subsequent steps independently of the thread layer. During the actual drawing in of individual warp threads on loom harness elements, in order reliably to avoid erroneous drawing due to erroneous separation, and in particular in connection with the drawing in of filament yarns on harness elements, an element referred to as a lease is therefore required as a separation aid for the individual threads or yarns. Leases are also known for the purpose of ensuring the ordering of the threads in a thread layer consisting of coloured threads or yarns.

However, the lease must also be crossed beforehand into the thread layer. In this situation, two bands or strings lying transverse to the warp threads are drawn or woven in between the warp threads. The bands cross in the area between each two warp threads. Due to the to and fro movement of the crossed bands the frontmost threads in each case are parted from the others, and then separated by separating means.

In the case of separation from a layer without a lease, the problem may arise that threads from the thread layer tensioned between the two tensioning points are crossed over. The consequence of this may be that it is not the threads in the layer which are actually the foremost in relation to the tensioning points which are located opposite the separating means for the next separation procedure. Rather, at this point it will actually be threads further to the rear which are foremost in relation to the tensioning points. If these following threads are then first taken up and carried away by the separating means, this may lead to looping of the threads which are actually the foremost with the threads which are being separated at that particular moment. Such looping imposes a particularly severe mechanical burden on the threads and often leads to thread breakage during a subsequent process. For this reason alone, such loops should be avoided without fail.

Separation errors of this nature should also be avoided, however, if a thread sequence is formed by a thread separation which does not accord with the warp thread repeat pattern. The term "warp thread repeat" is to be understood to mean a predetermined sequence of thread types, such as of the colour or diameter of different threads. Deviations from the warp thread repeat due to separation errors can lead to visible weaving errors subsequently in the weaving process.

Such separation errors and their consequences are either absorbed or avoided by manual intervention in previously known devices.

The invention is therefore based on the problem of creating the possibility of at least certain of the separation errors described being avoided by mechanical intervention.

The problem is resolved according to the invention with a device comprising a storage device for the intermediate depositing of at least one thread, which can be separated from a thread layer arranged tensioned in tensioning means, in which the storage device is provided with at least one storage means, which exhibits at least one take-up element arranged outside the plane of the thread layer, whereby the take-up element is provided and designed for the arrangement of one or more of the threads under tension, and the storage device also exhibits at least one transfer means, with which the individual thread can be transferred to the storage means. The problem is further resolved by a method. The invention is basically well-suited for any device in which threads are to be separated in a specific sequence, such as, for example, leasing or warp thread drawing devices.

According to one embodiment, it may be the purpose for a thread which is separated but not yet in turn for the actual handling respectively separation process, to be temporarily removed from the actual operational process, temporarily stored, and to be inserted again into the process, for preference in accordance with a predetermined sequence of threads. The decision as to whether a thread is transferred out of the process, for example from the leasing step, into the intermediate storage means, can in principle also be carried out manually. For preference, however, this decision is to be taken automatically by means of a device. To do this, a detection device can be provided for, which acquires the actual-state data of the thread layer. By means of this, the thread repeat, which has been stored, for example, in a machine control system in the form of electronic data, can be compared by the control system with the actual-state data of the thread layer as determined by the detection device. In the event of the control device determining any deviations between the actual-state and the reference data in relation to the criteria being compared, for example with regard to the colour sequence of the threads, then the machine control system will arrange for the transfer of the thread to the intermediate store.

It has been proved to be of advantage if the intermediate store can be arranged not in the plane formed by the thread layer but next to it. This allows the separating means a free lateral access to the beginning of the thread layer and therefore to the frontmost thread in each case. In addition to this, the threads can be deposited in the store without being subjected to overmuch mechanical stress.

In connection with the invention, a structural design of the storage device is preferred which will allow for a thread to be passed along a conveying stretch to the storage means, and to be taken up from this, and for the same thread to be given up again essentially along the same conveying stretch. This allows, in a particularly simple manner in temporal terms after the separation of this thread, for one or more threads to be separated from the thread layer and to be handled independently from the storage means. The thread which is temporarily stored in the storage device does not interfere with these handling procedures. Once predetermined criteria pertain, it can again be taken out of the storage means.

The threads are for preference taken out of the storage means essentially along the same conveying stretch along which they have passed before to the storage means. If the threads, after being taken up, are moved inside the storage means, they can, in a manner useful to the purpose, pass along the same path again to a position in which they are passed over by the storage means. This can reduce the size and complexity of the design in connection with the storage device, since transfer means with which the threads are handed over to the storage means can also be used to guide the threads back again.

In cases in which loops in the threads may pertain, but are to be avoided, it may be of advantage if the storage device according to the invention exhibits at least two storage means. Of the two storage means, to the purpose one of the storage means should be arranged on each side of the thread layer. This allows for a separated thread lying crossed over another thread to be temporarily stored on the side of the thread layer on which the thread which is ready to be handled at that particular moment crosses the other thread. The thread which has been taken up, or the next to it in relation to the separating means but not yet to be conducted to the treatment process, can therefore remain on its "crossing side" of the thread layer. Because a storage means is provided for on each side of the thread layer, this thread does not need to be conducted around the other thread. A looping of the threads can therefore be avoided. For the storage process, the thread need therefore only be removed from the thread layer on its crossing side sufficiently for it not to interfere with the separation step for the following thread.

A favourable design embodiment of a storage means can make provision for a spindle, capable of rotation about its longitudinal axis. The spindle should be provided on its casing surface with take-ups for one or more threads. It has proved to be to the purpose if the take-ups are formed by a screw thread arranged on the casing surface.

In a preferred embodiment of the invention, detection means, for preference optical detection means, are provided for the determination of specific properties of the threads. The optical detection means can be formed, for example, as a colour camera, provided with lighting means. Other forms of identifying thread properties are of course also possible; metallised threads can, for example, be detected by inductive sensors.

The colour camera covers at least the area in which it is intended that the next thread in each case is to be separated. From the optical information which the camera provides, in connection with a preferred embodiment of the present invention, at least one item of colour information is required. This information is compared in the control system with data relating to the warp thread repeat. The data regarding the warp thread repeat should at least contain information about the reference sequence of the threads by indicating their colours or other characteristics.

In a preferred embodiment of the invention, it is possible for information about the location of an initial layer to be contained, in which the thread was arranged during the assembling of the part layers to form the (overall) layer to be separated according to the invention. In particular, multicoloured layers are usually formed by several single-colour initial layers being merged (assembled). Thread layers produced in this manner are also designated as warp thread layers, although the layer as a whole is usually located in only one single plane. This information, deposited in electronic form in memory means of the machine control system at least with regard to the relative positions of the initial layers (layer stack sequence) can be utilised to advantage in particular if more than one storage means is provided. This will be considered in greater detail hereinafter.

With the invention it is now also possible, in a relatively simple manner, for a thread lease to be entered into a multi-layer warp yarn. The term "part layer of a multi-layer warp yarn" can be understood to mean a specific number of threads of the layer which are assembled on the basis of their characteristics, for example because they exhibit the same colour. A part layer can therefore correspond to an initial layer before assembling, but this does not necessarily have to be the case. The sum of all the part layers can then form the multi-layer warp yarn.

For the separation of threads from such a multi-layer warp yarn, it was hitherto usual for the warp yarn to be tensioned between two clasp rods. A lease bar was introduced between the clasp rods for each (part) layer. By means of lease rods it was possible to create a height difference between the individual part layers of the warp yarn. This made it possible to avoid erroneous separation at the transfer from one part layer to the next, the result of which would be errors in the thread repeat. It has been found to be disadvantageous in this respect, however, that an individual separation point must be created for each height or part layer.

With the present invention, such lease rods and the effort associated with their insertion into the warp yarn can be done away with. Thanks to the invention, it is no longer necessary for the warp to be tensioned in multiple layers in order thereby to obtain a reliable and correct separation of the individual threads. Such warp threads layers are, for preference, tensioned between only two clasp rods, without the need for any additional aids. By way of a separating means, one thread can then be separated from the other. If it is detected at layer crossing points, i.e. at the transition from a thread of a first property (for example the colour) to a thread of another property, that there are deviations from the warp thread repeat, then the straight separated thread can be transferred into the store. The thread is removed from the store once again as soon as it has been determined, after the separation of at least one further thread, that the thread located in the store is now to be separated according to the warp thread repeat.

Figure 2A:
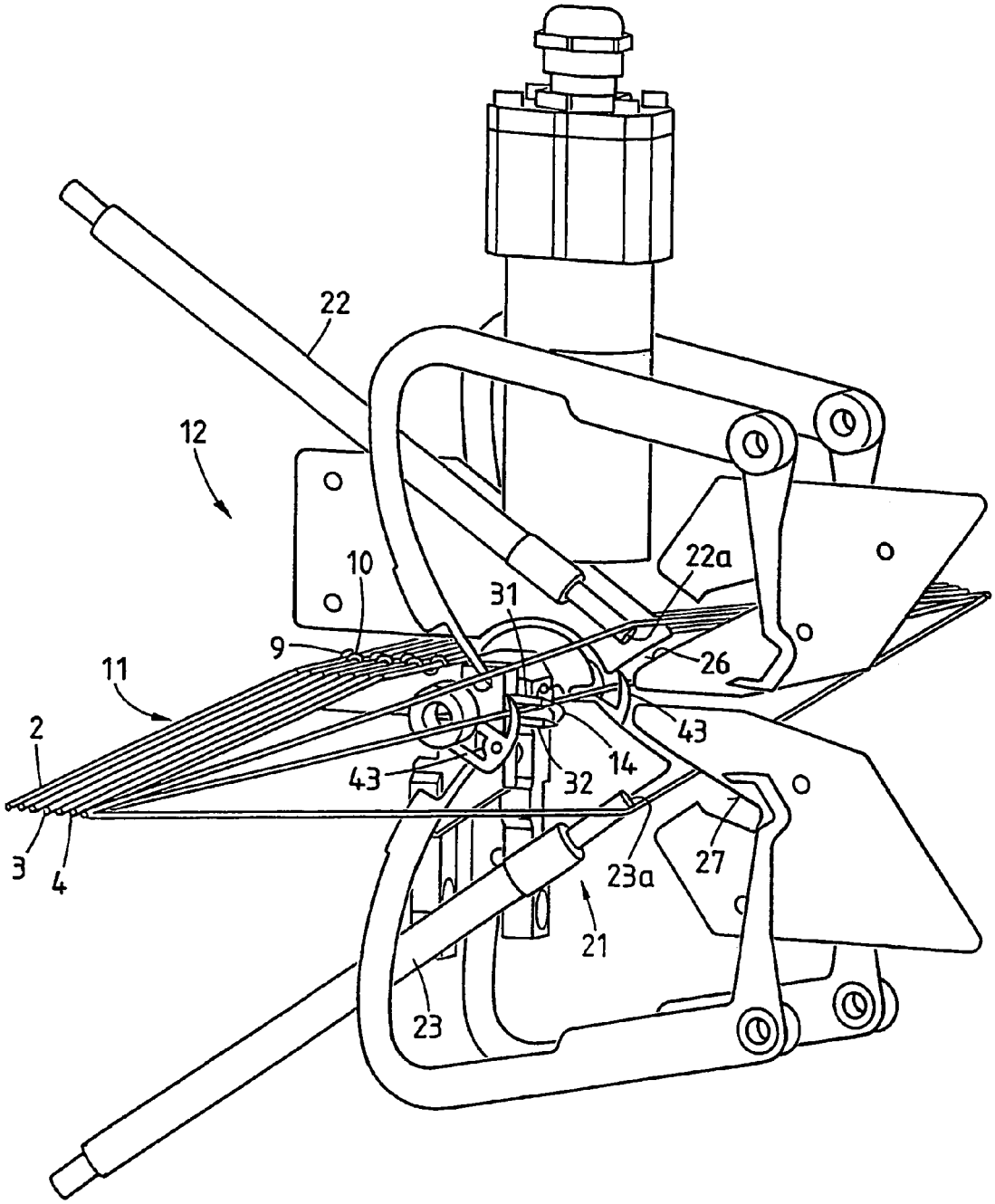
Figure 2B:
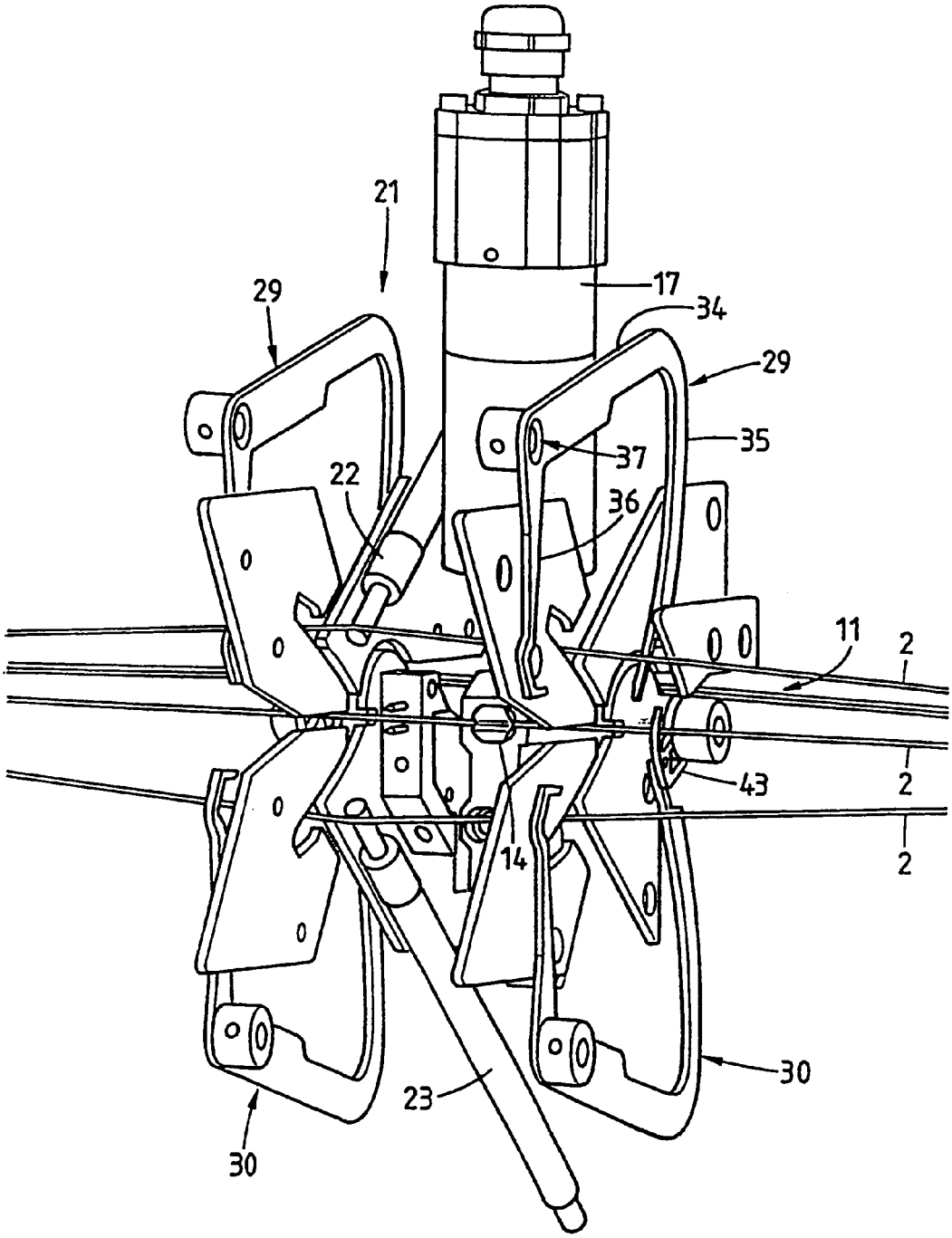
Figure 3:
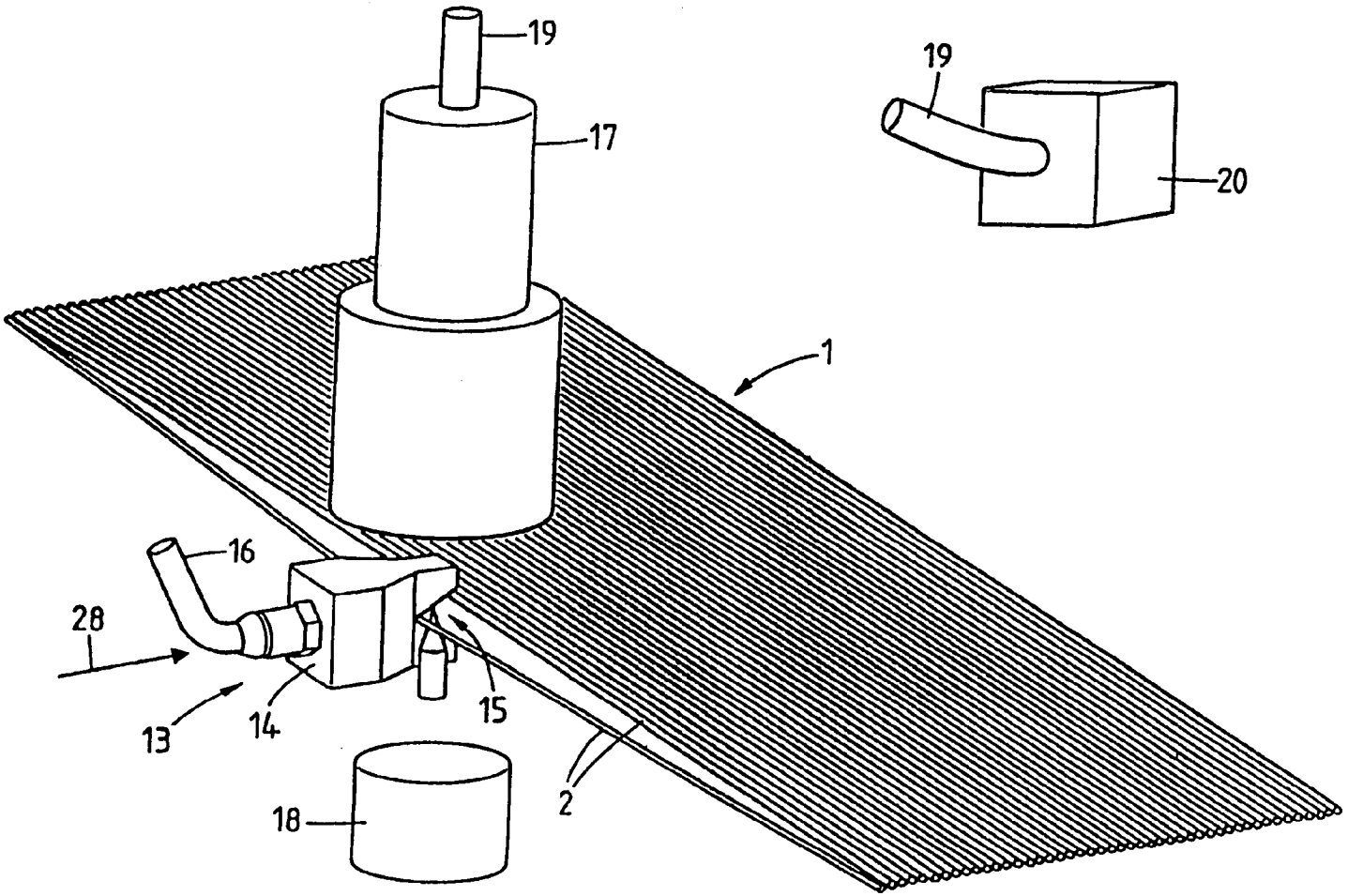
Figure 4:
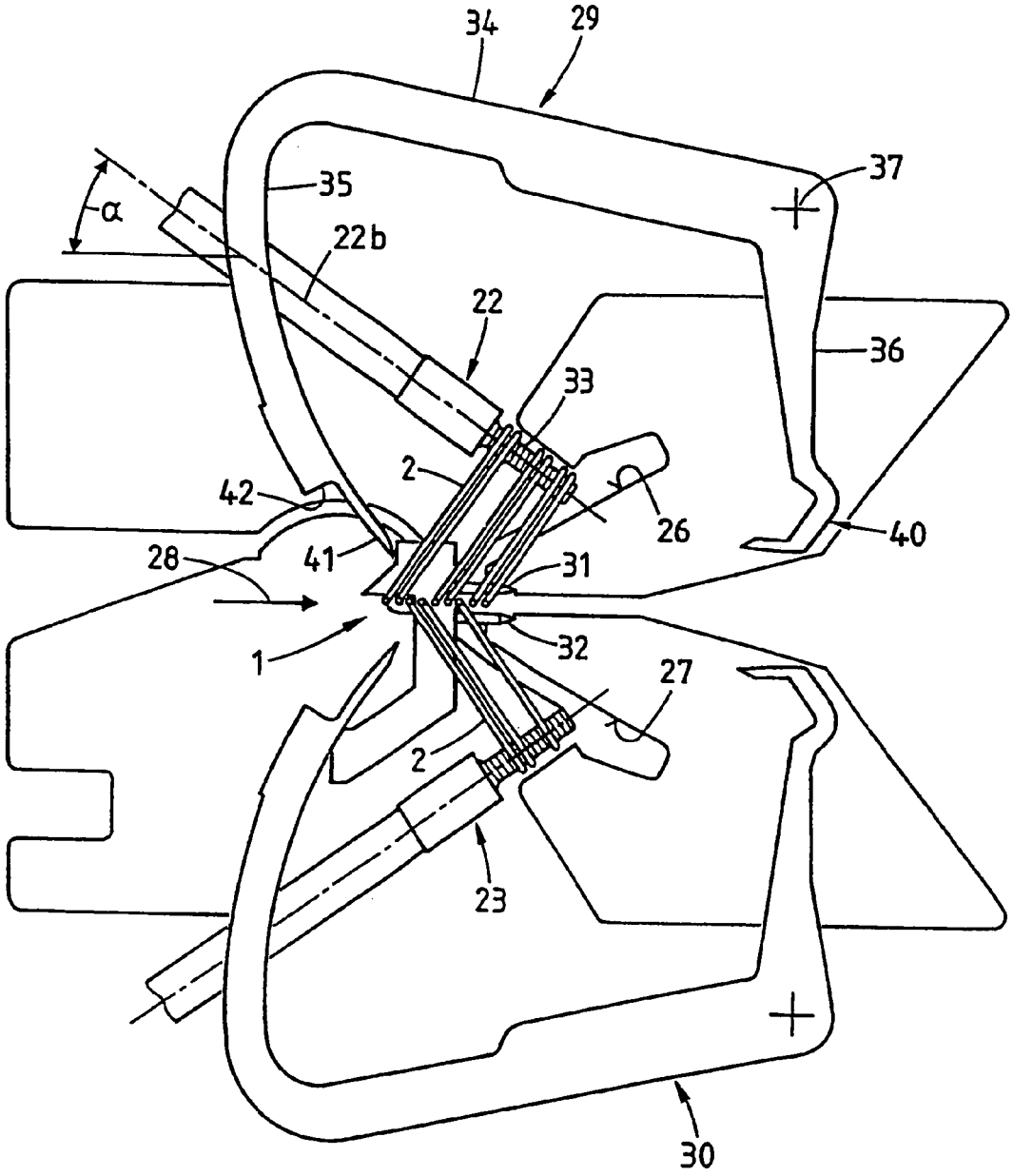
Figure 5:
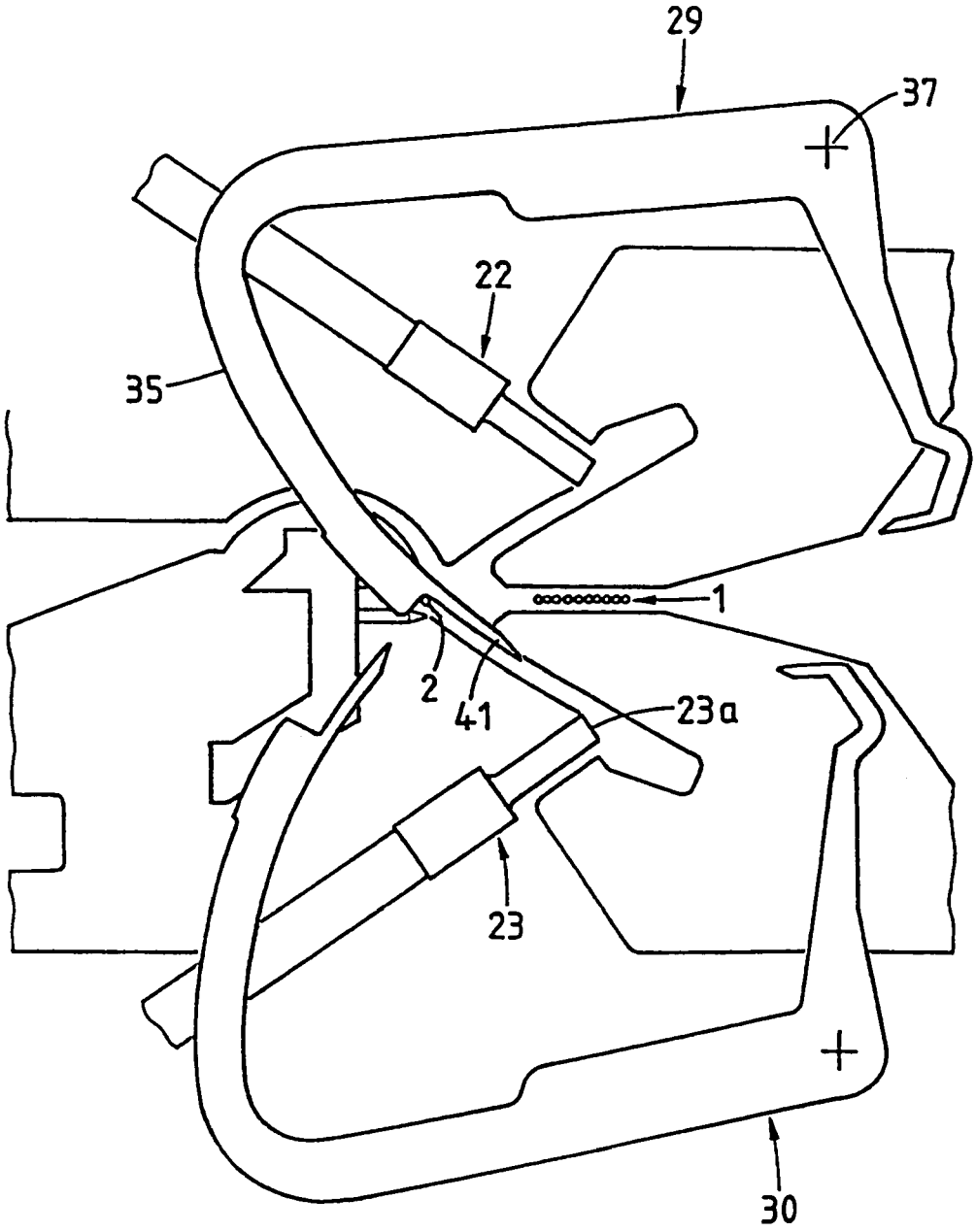
Figure 13B:
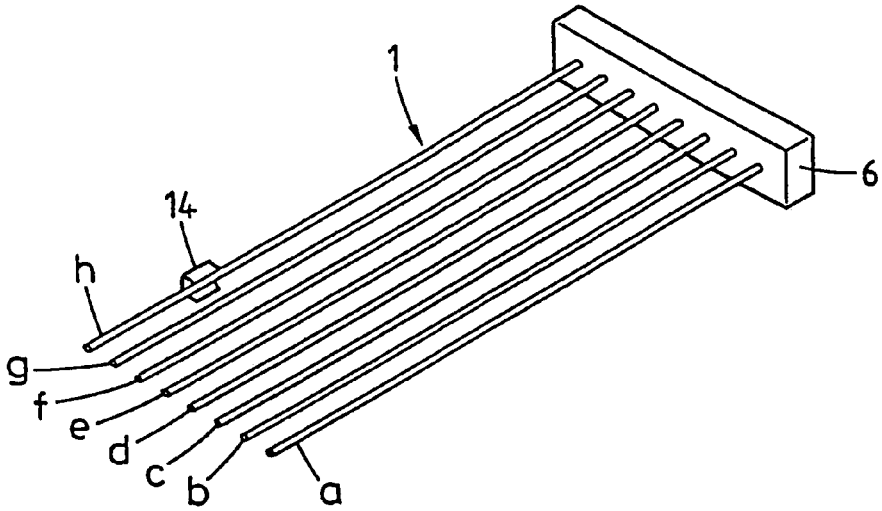
Figure 13A:
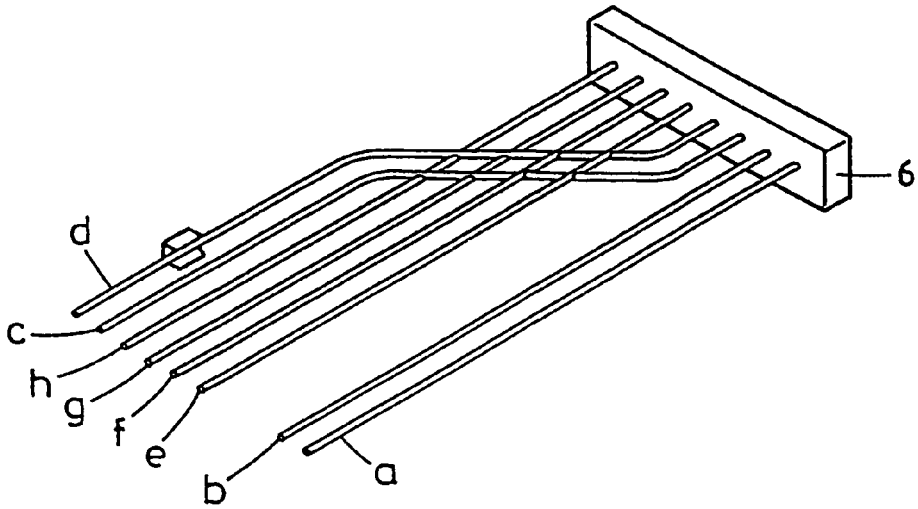

The invention is explained in greater detail on the basis of embodiments represented in diagrammatic form in the figures; these show:

FIG. 1 A part of a thread layer;

FIGS. 2*a*, 2*b* A partially represented lease entering machine according to the invention, in two representations;

FIG. 3 A separating means together with detection means of a leasing machine according to the invention;

FIG. 4 A partial front view of a leasing machine according to the invention;

FIGS. 5-12 A sequence of method steps for the intermediate storage and removal of a thread in accordance with the representation of FIG. 4;

FIG. 13*a* An actual condition of a part of a thread layer;

FIG. 13*b* A reference condition of the part of the thread layer shown in FIG. 13*a;*

Figure 13C:
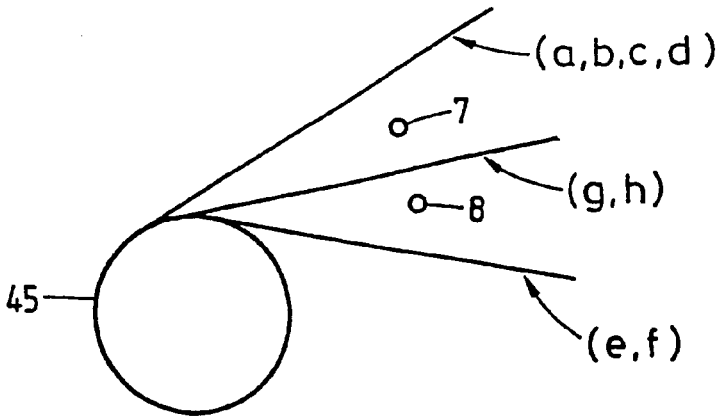

FIG. 13*c* A layer stack sequence of the layer from FIG. 13*a* and FIG. 13*b;*

Figure 14A:
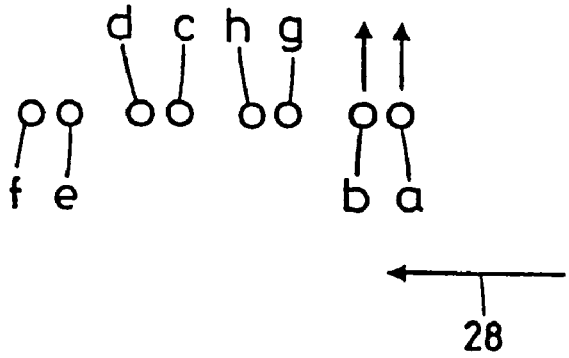
Figure 14B:
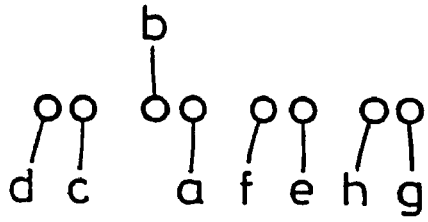
Figure 14C:
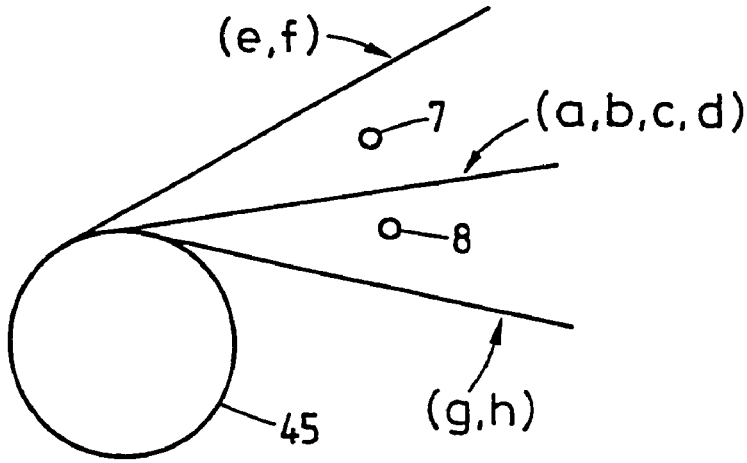

FIG. 14*a*-14*c* A further embodiment of the representations according to FIGS. 13*a*-13*c*.

In FIG. 1, a warp thread layer 1 is shown in sections, of which the individual threads 2, 3, 4 are tensioned over a longitudinal section of each thread between two clasp rods 5, 6 in each case.

The threads 2, 3, 4, running essentially parallel to one another are under slight tensile stress between the only two tensioning points and form the essentially flat thread layer 1.

In the thread layer 1 of FIG. 1, threads 2, 3, 4 of different colours are provided for, whereby a predetermined number of threads 2 of the same colour, threads 3 of the same colour, and threads 4 of the same colour always form one part layer. In FIG. 1, different threads are symbolised by different line thicknesses. In order to be able to separate threads with different properties from one another, two elements referred to as separation bands 7, 8 are inserted into the thread layer 1 between the two tensioning points. The bands 7, 8 also run essentially transverse to the threads 2-4 of the thread layer and therefore approximately parallel to the clasping rods 5, 6. Such layer separation bands 7, 8 have long been known and are already inserted in the conventional manual production (assembling) of a thread layer 1 with threads of different properties (such as colour, material, diameter, etc.).

In the embodiment, one of the two layer separation bands 7, 8 changes the side of the thread layer 1 at each of the places at which a colour changes takes place in the thread layer 1. At these places, therefore, threads of a different colour lie next to one another. By the displacement of the thread separation bands it is therefore possible for the part layers to be separated from one another. Such thread separation bands 7, 8 and their function are already known.

It is now intended that a device referred to as a lease, already long known, should be additionally introduced into the thread layer 1. The lease shown in FIG. 2 usually consists of two crossing threads 9, 10, which, like the thread separation bands 7, 8 from FIG. 1 run essentially transverse to the longitudinal extension of the threads 2-4 of the thread layer. In contrast to the layer separation bands 7, 8, not shown in FIG. 2, the leases 9, 10 change the side of the thread layer behind each colour. Accordingly, the crossing threads 9, 10 cross one another behind each of the threads 2-4, and so separate the individual threads 2-4 from one another. With the aid of a lease it is therefore possible for a separation of individual threads to be carried out in an accelerated fashion. A rapid separation of individual threads 2-4 is required, for example, with a subsequent drawing in of loom harness elements onto the threads of the thread layer by means of a warp thread drawing-in machine.

The leasing device 12 shown in FIG. 2 is provided in order to introduce such a lease into a thread layer. Accordingly, in FIG. 2, on the left-hand side of the representation, a lease of this type can be seen, drawn into the processed part 11 of the thread layer, with crossing threads 9, 10. The leasing device 12 exhibits for this purpose a separating means 13, shown only in FIG. 3, which for preference can be designed as a suction nozzle. The suction nozzle exhibits a tapering gap, the longitudinal extension of which runs parallel to the direction of the threads 2-4. The gap 15 opens into an underpressure line 16, which is connected to underpressure means, not shown, such as a pump. As a result of this, an underpressure can be created in the gap 15, by means of which individual threads 2-4 can be held in the gap 15. The underpressure should be sufficiently large for thread 2, which is still tensioned between the two tensioning points and sucked in by the suction means, can be moved with the suction nozzle 14 from the thread layer 1.

The suction nozzle is mounted to a conveying carriage, not shown, by means of which the suction nozzle 14 can be conveyed within the plane of the thread layer 1 and essentially transverse to the longitudinal extension of the threads 2-4. As a result of this, the suction nozzle 14 can be positioned in front of the frontmost threads 2-4 in each case. The suction nozzle can additionally be moved relative to the conveying carriage in the plane of the thread layer, in order to acquire a thread and, by means of a movement away from the thread layer, to separate the thread as is shown in FIG. 3.

Likewise arranged at the conveying carriage is a detection means, formed from a colour camera 17 and light source 18, with which properties of the threads can be determined, especially of those threads which are acquired by the suction nozzle and carried by this away from the thread layer. Such a device has been disclosed in the Swiss Patent Application CH 2001 0754/01 by the same Applicant. The contents of the disclosure in respect of the design structure and the method which can be carried out with this device of the older application are hereby adopted in full by way of reference.

The resolution capacity of the colour camera 17 should in this situation be selected as such that individual threads, in particular the colours and contours of the individual threads 2-4, can be identified. The image generated by the camera 17 is passed via a data line 19 for evaluation to an electronic control unit 20 of the leasing device. Provided in the control unit is colour identification software, with which, on the basis of the data supplied by the camera 17, the colour of individual threads 2-4 can be determined. Suitable programs for carrying this out are in principal already known. They are often based on the method of what is referred to as colour space transformation, in which the elements of the primary colours (red, green, blue) are determined for specific colour ranges by comparison with reference colours. Complete systems of camera or colour sensor respectively and evaluation software can be obtained, for example, from the company of Optronik GmbH, Berlin, Federal Republic of Germany, or from Ziehmann & Urban GmbH, Erding, Federal Republic of Germany.

A warp thread repeat can be deposited in the control unit 20. In connection with the embodiment shown, the term "warp thread repeat" can be understood to mean data or information about the colours of the individual threads 2-4 and their reference sequence. Likewise, it can also be understood to mean information about the places in the thread layer at which in each case a change takes place from a thread of a first colour to a thread of a second colour. This information can also be deposited in other forms, for example by the indication of the number in each case of sequential threads with the same properties. In addition to this, or instead of colour information, information could also be deposited regarding the thread thickness and the sequence of the threads with specific thread thicknesses in the thread layer as a warp thread repeat. If it is intended that the reference thread thicknesses should be compared to the actual thread thicknesses, then the control device exhibits suitable image recognition software for this purpose.

The leasing device is provided with a storage device 21, according to FIG. 2*a*, 2*b* and FIG. 4, with which threads from the thread layer plane can be transferred into an intermediate store and can be temporarily stored there. To do this, in the embodiment represented, provision is made on each side of the thread layer 1 for storage means in the form of a spindle 22, 23, set obliquely to the thread layer 1. Provided opposite each spindle end 22*a*, 23*a* is an oblique sliding surface 26, 27, which is inclined in the operational direction (arrow 28) towards the thread layer plane. The term "operational direction" is to be understood to mean the direction in which the lease machine processes the thread layer. To achieve this, two approximately U-shaped pivot levers 29, 30 are arranged on each side of the thread layer plane as transfer means. The two pivot levers 29 and 30 respectively, which in each case are located on the same side of the thread layer, are synchronised with one another, as a result of which they always carry out a pivot movement together. Finally, arranged on each side of the thread layer 1, parallel to and at a slight distance from it, is a rod-shaped catchment element 31, 32.

The spindles 22, 23 and the pivot levers 29, 30, like the suction nozzle 14 from FIG. 3, the catchment elements 31, 32, and the sliding surfaces 26, 27 are located on the conveying carriage, not shown. Together with the conveying carriage, these components can be moved backwards and forwards parallel to the plane of the thread layer 1 in the operating direction 28. In addition to this, the two pivot levers are slightly offset to one another in relation to a direction running perpendicular to the plane of the drawing in FIG. 4, as a result of which the pivot levers 29, 30 can be pivoted into positions in which they partially overlap.

In view of the fact that the spindles 22, 23 and the pivot levers 29, 30 are arranged on both sides of the thread layer 2 mirror symmetrically to the plane of the thread layer 1, hereinafter in each case only the structural design of one of the spindles 22, 23 and one pivot lever 29, 30 will be described.

The spindle 22 is arranged with its longitudinal axis 22*b* (FIG. 4) arranged opposite the thread layer 1 obliquely at an angle $\alpha$, and specifically in such a way that the free end 22*a* of the spindle 22 is closest to the thread layer 1. The free end 22*a* also points in the operational direction (arrow 28) of the thread layer. Starting from its free end 22*a*, the spindle 22 is provided along a section with an outer thread 33, which winds several times about the spindle 22 along the entire circumference. Each of the thread turns formed as a result represents a retaining means for one of the threads 2-4, as described in greater detail hereinafter.

The spindle 22 is connected at its other end to drive means, not shown. As a result, the spindle can rotate at infinitely adjustable speeds of rotation and in both directions of rotation about its longitudinal axis 22*b*.

The two spindles 22, 23 are synchronised with one another, so that they are capable of being driven jointly at the same speed. In addition to this, with one of the spindles moving in a specific direction of rotation, the other spindle always exhibits the same direction of rotation.

The pivot lever 29 of the transfer means exhibits a connection arm 34, which connects a catchment arm 35 to a transfer arm 36. Both the catchment arm 35 and the transfer arm 36 in each case have a free end, which is used for the handling of threads and is designed for this accordingly. The pivot lever is jointed such as to pivot in the area of its connection arm 34 about a pivot axis 37. The corresponding pivot movement can be created by means of a motor drive, not represented in any greater detail. The pivot axis 37 of the pivot lever 29 in this situation runs perpendicular to the plane of the drawing in FIG. 4, and therefore essentially parallel to the threads of the layer. The pivot axis 37 is also located at the point at which the connection arm and the transfer arm meet one another. In the neutral end position of the pivot lever 29, shown in FIG. 4, the transfer arm is located, in relation to the operating direction 28, in front of the catchment arm 35 of the pivot lever 29. The ends of the two arms 35, 36 in this situation initially exhibit approximately the same distance from the thread layer.

Immediately below the pivot axis 37, the transfer arm 36 in the neutral end position extends at approximately right angles to the plane of the thread layer 1. A hook 40 formed at the free end of the transfer arm is angled at three points, so that an approximate U-shape is derived for the hook.

The catchment arm 35 features a slight camber in the direction towards the transfer arm 36. In the area of its free end, it has a substantially smaller width, by means of which a needle-shaped tip 41 is formed. The tip 41 passes at a step 42 into the broader section of the catchment arm 35.

In order to introduce a lease into the single-layer thread layer, in approximately the middle between the two tensioning points, the suction nozzle 14 is moved laterally at the first threads of the layer 1 in the operational direction. Due to the underpressure exerted by the suction nozzle, the first thread is acquired and moved away from the thread layer by a predetermined stroke path, against the operational direction. By means of the camera 17 and the colour identification software provided in the control unit 20, the colour of the acquired thread 2 is determined. This information is compared with the reference colour deposited in the warp thread repeat. If the reference data concurs with the actual-state data, then, with a pivot movement of a transfer element 43 (for example with the pivot hook shown in FIG. 2*a*, 2*b*), the thread 2 is guided away in an inherently known manner.

Thereafter, one after another, with the suction nozzle 14 in an inherently known manner, the thread is acquired which is now in each case the frontmost of the thread layer, and is separated from the thread layer. With the camera 17, by means of an image or colour recognition process carried out by the evaluation software, it can be detected whether in fact an individual thread 2 has been acquired. In the embodiment shown, provision is also made for the control unit to carry out a comparison on the basis of the colour information relating to the individual thread separated in each case, provided by the camera and to be evaluated by the control unit. In this situation, this (actual state) colour information is compared with the (reference) colour information for the thread, which is contained in the warp thread repeat. If the control unit 20 detects any deviation during this comparison, then it can be assumed that a cross-over of the thread acquired by the suction nozzle 14 must pertain with one or more other threads which, according to the warp thread repeat, are actually intended to be in front of this thread.

Figure 6:
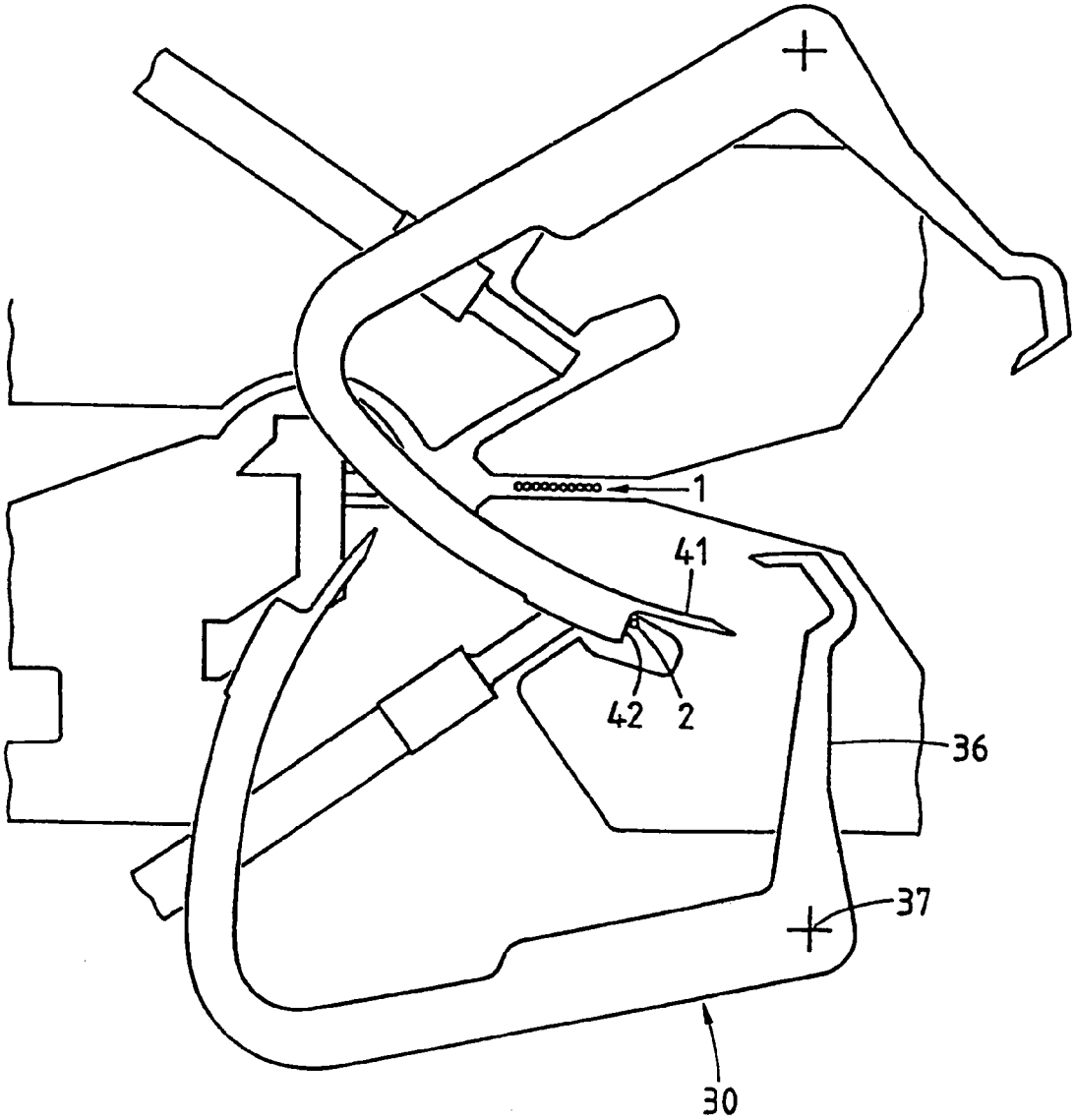
Figure 7:
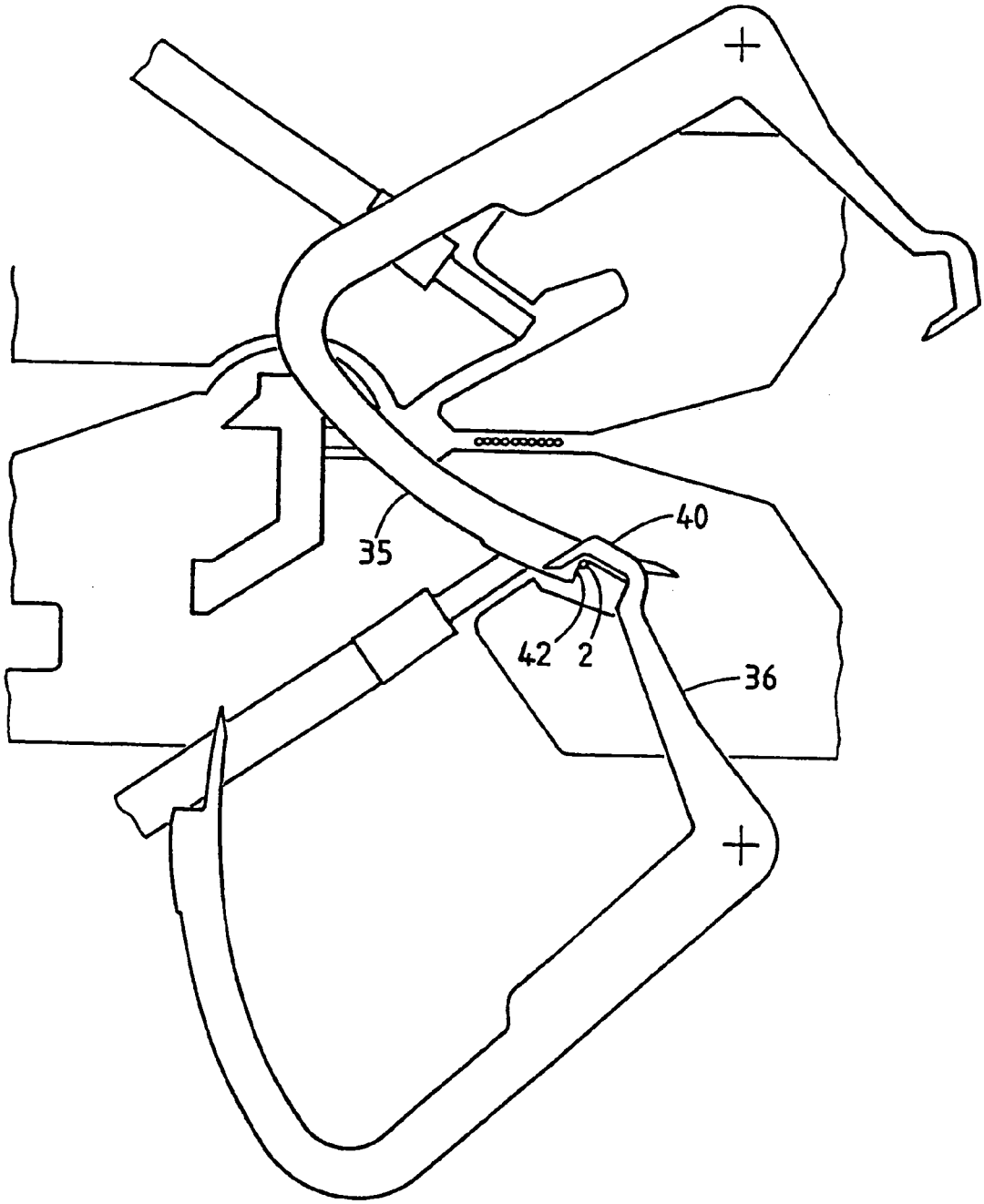

In order to be able to re-establish the reference sequence of the threads, the acquired thread 2 is transferred into the intermediate store and deposited there. To do this the pivot lever 29 is actuated, as a result of which the catchment arm 35 is moved to the thread layer 1. Due to its circular trajectory, the tip 41 passes into the gap between the frontmost thread and the thread following it, enlarged by the suction nozzle 14. With the step 42, the catchment arm 35 then acquires the thread 2, and carries this along on its trajectory. This situation is reproduced in FIG. 5. On its predetermined conveying path, the thread 2, which continues to be tensioned between the two tensioning points is guided on somewhat further at the spindle end 23*a*. The movement of the catchment arm is stopped at a point at which the broader rear face of the catchment arm 35 is located opposite the spindle 23. This is shown in FIG. 6.

Figure 8:
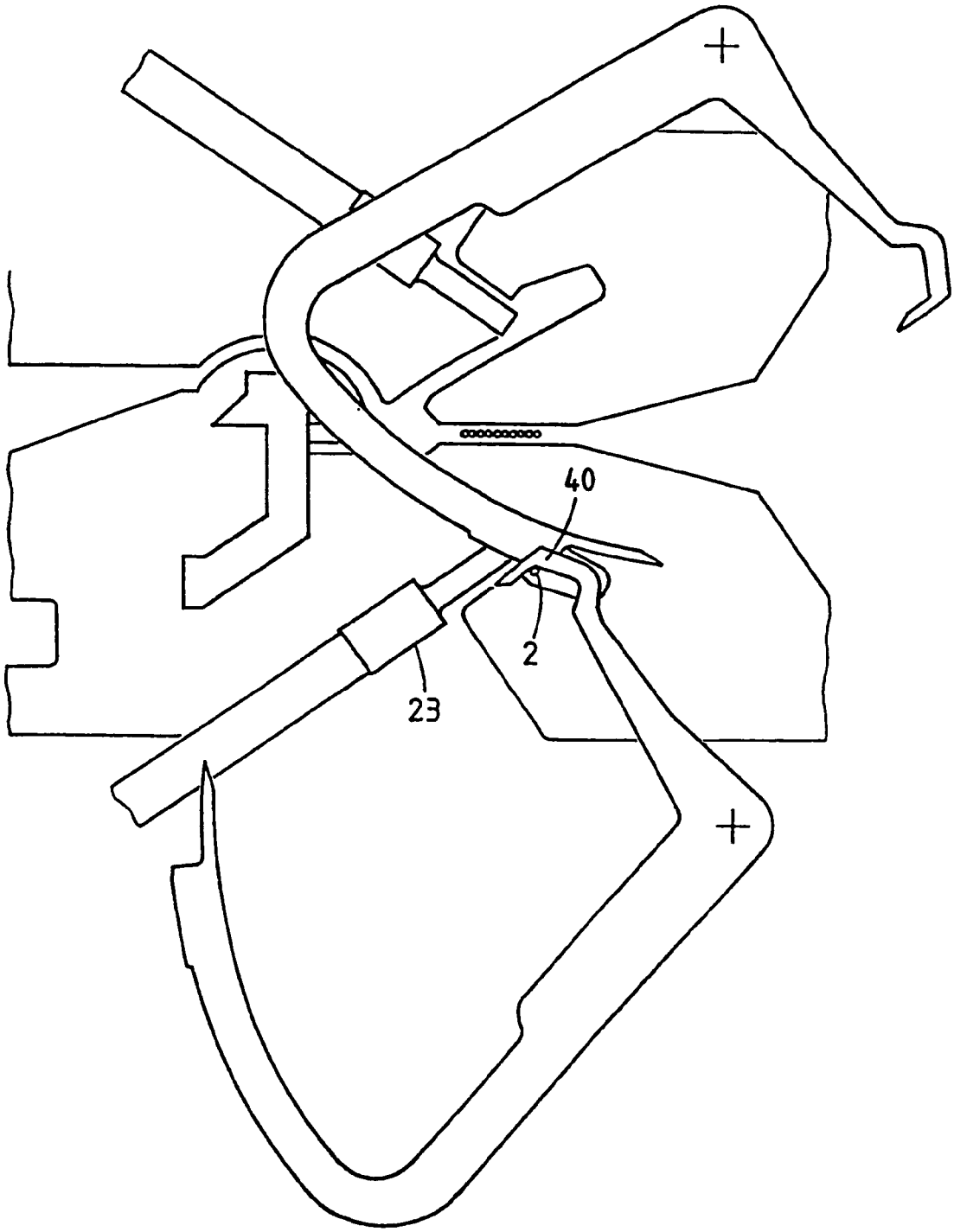
Figure 9:
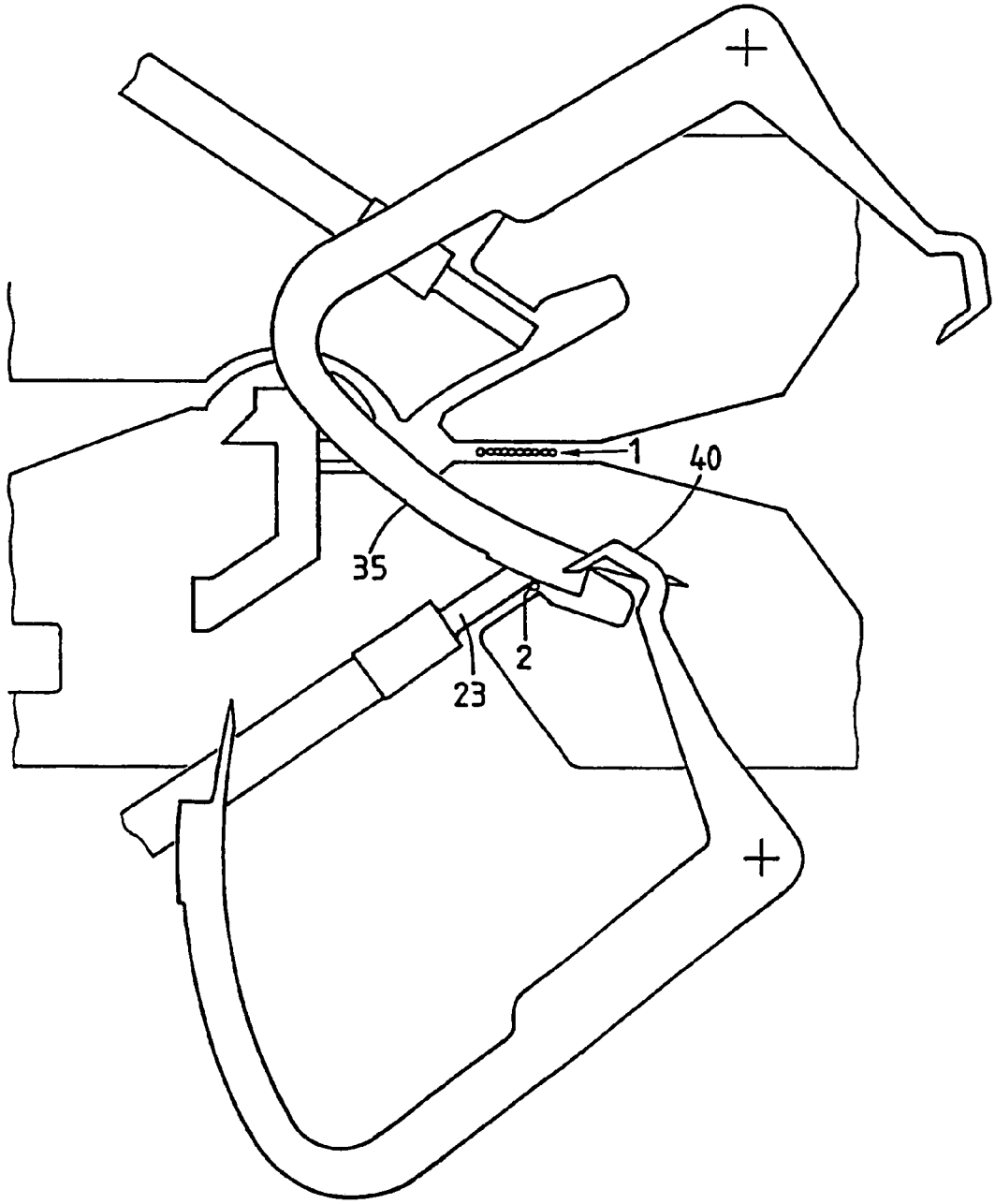
Figure 10:
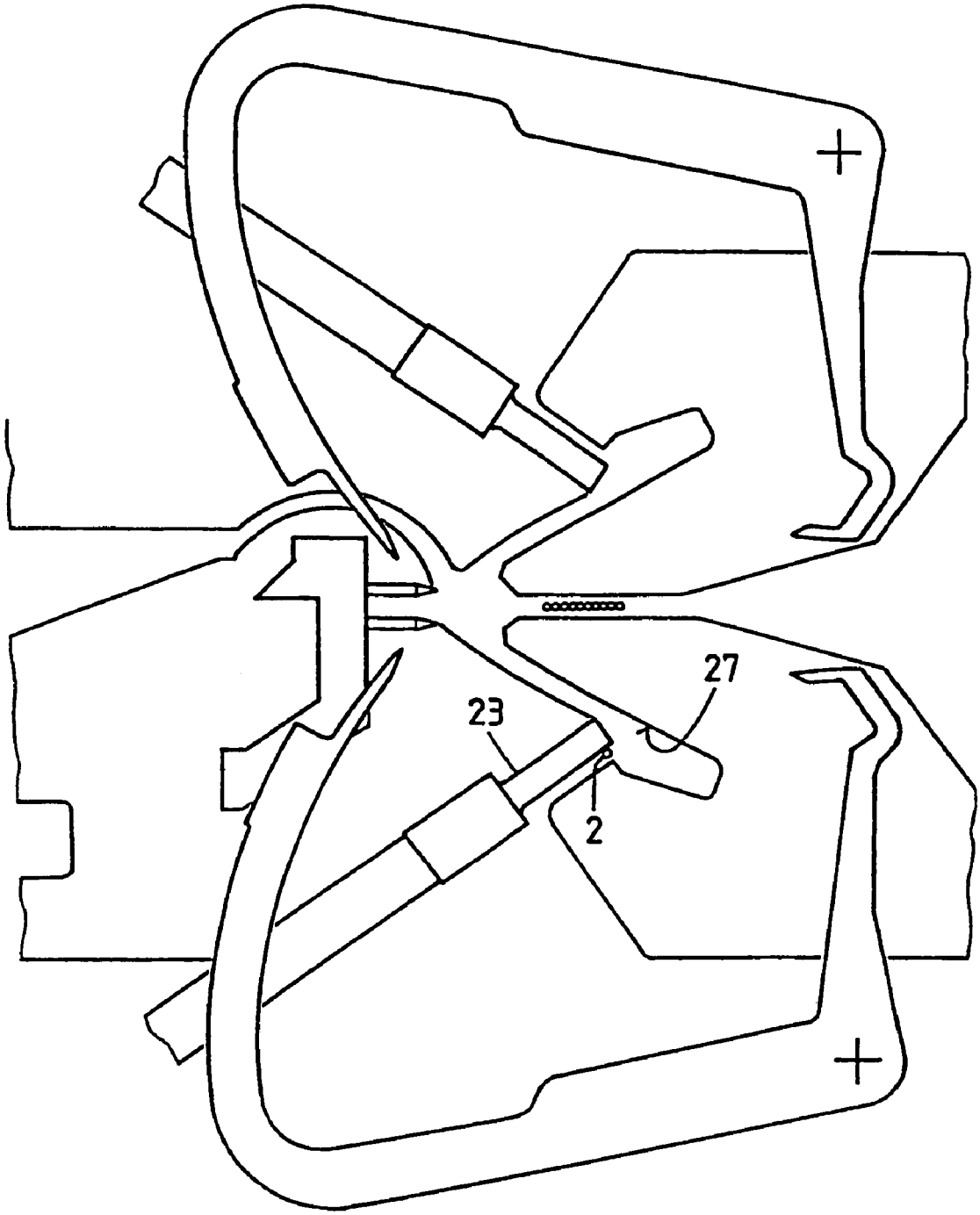

By an actuation of the other pivot arm 30, which can be initiated before or after the catchment arm has reached this end position, its transfer arm 36, on a likewise circular trajectory about its pivot axis 37, can be brought close to the thread 2 which has been deflected out. During its further movement, the hook 40 of the transfer arm grasps the thread 2 immediately next to the catchment arm 35, and takes over the thread (see FIG. 7). The catchment arm is at this moment staying in its position, so that the transfer arm can guide the thread, with the middle section of its hook 40, by its further rotational movement, over the step 42 of the catchment arm onto its broader rear face (FIG. 8). As soon as this has been reached, the transfer arm 36 begins to rotate back into its neutral end position. The thread, released by the transfer arm, because of the spring tension applied, now slips on the curved back of the catchment arm 35 in the direction of the thread layer, and so passes into the first thread turn of the spindle 23 (FIG. 9). The catchment arm 35 can then also be rotated back into its initial position.

The spindle 23 is then actuated in a direction of rotation which, seen from the free end 23*b* of the spindle, corresponds to the direction of rotation of the thread. This has the consequence that the thread is carried along by the spindle thread and moves relative to the longitudinal axis of the spindle in a straight-line movement on its casing surface. The movement should then be stopped at the earliest when the thread is being reliably held onto the spindle by the spindle thread. The thread 2 is therefore held in temporary storage.

After both pivot arms 29, 30 have been transferred into their initial position once again, the suction nozzle 14 can separate what is now the frontmost thread, as shown in FIG. 3 and described heretofore. On the basis of the data provided by the camera 17, and a comparison with the warp thread repeat, it is again determined in each case whether this thread corresponds to the thread which was anticipated according to the warp thread repeat. If this is the case, the thread is acquired by the transfer means 43 and guided onto the processed side 11, i.e. the leasing side of the machine (FIG. 2). At this location, the two crossing threads 9, 10, have already been crossed beforehand in front of the threads transferred onto the leasing side. As a result, the two threads last transferred across are also physically separated from one another.

If the control unit, again on the basis of the warp thread repeat, now determines that the thread located in the temporary store is to be brought as the next thread onto the transfer side, a removal process is set in motion.

Figure 11:
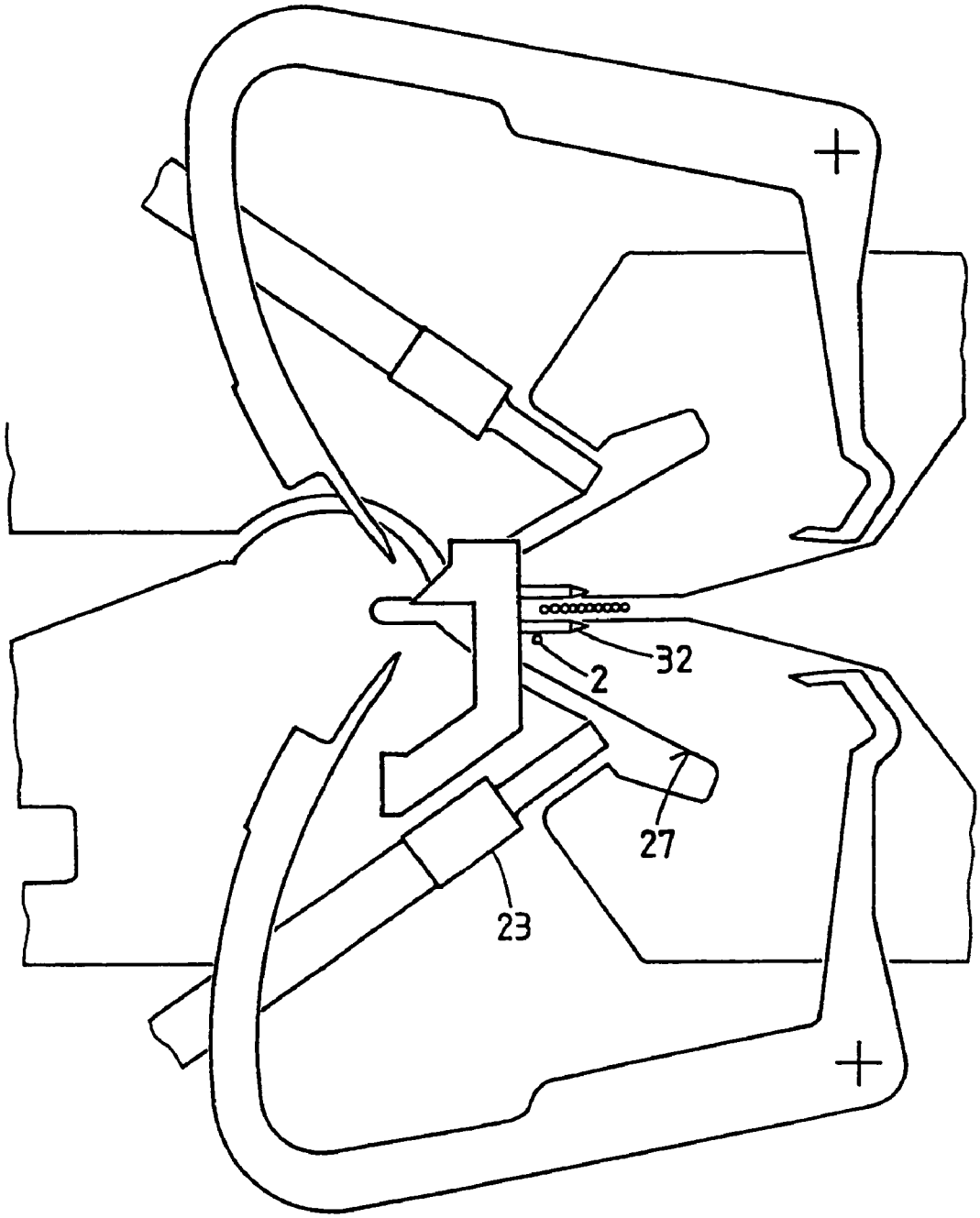

To do this, the same transfer arm 36 is pivoted in the direction onto the spindle 23 with which the thread 2 has already been placed onto the spindle 23. The hook 40 of the pivot lever 30 is in this case arranged immediately beneath the free end 23*b* of the spindle 23, and the spindle is rotated contrary to its direction of rotation when taking up the thread 2. As a result of this the thread is guided in the direction onto the spindle end, and finally released by the spindle 23. The hook 40 then catches the thread 2. As a result of this transfer arm 36 pivoting back into its neutral end position, the hook 40 then releases the thread 2. Because of its tensile stress, the thread then passes onto the guide element, on the inclined sliding surface 27 of which the thread then slides back in the direction of the thread layer 1. The catchment element 32, which in the meantime has moved forwards in the direction onto the layer and is arranged above the first thread of the layer, catches the thread 2 (FIG. 11).

Figure 12:
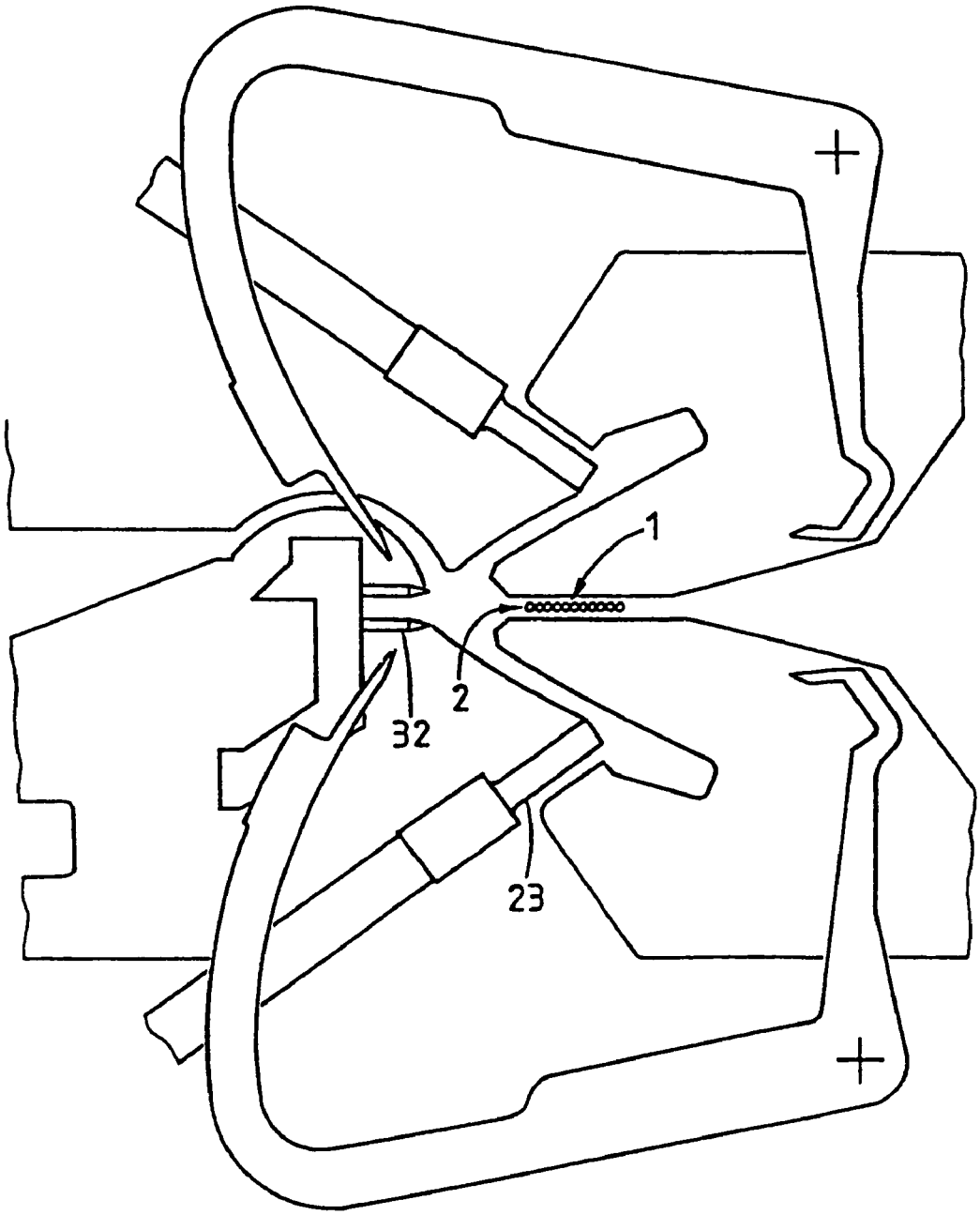

After the thread has come to rest on the catchment element 32, the catchment element 32 can be moved back. The thread 2 in this situation, now as the frontmost thread 2 of the layer 1, then moves back into the layer (FIG. 12). Because the thread 2 has been guided in a predetermined manner as a result of this, a large part of the energy contained in the thread has already been dissipated before it passes back into the layer. As a result, the thread reaches the plane of the thread layer with only a little residual kinetic energy, as a result of which any backswing of the thread can to a very large extent be avoided. The thread can now be separated from the thread layer by means of the suction nozzle, and then transferred to the leasing side.

Based on this preferred principle according to the invention, it is possible to react to a plurality of possible positions of individual threads to one another in connection with the separation of threads from a thread layer. Of these, a number are represented hereinafter by way of example:

It may occur, for example, that several threads 2 must be transferred into the temporary storage means before it can be emptied. In the case shown in FIG. 4, the spindle 23 is intended to be further rotated by at least one revolution in each case for each separated thread 2 in the take-up direction, provided that this relates to threads of different colours or properties. As a result, it is ensured that threads of different colours are separated from one another in the storage means by means of the spindle thread. If, by contrast, the thread which was last deposited in the storage means and the thread which is to be newly deposited belong to the same part layer, then these two threads do not necessarily have to be physically separated from one another in the storage means. They can be located on the storage means within an area which is smaller than a rotation of the spindle thread.

A further rotation of the spindle, with each of the threads which are to be separated, about a specific angle of rotation can also be to advantage, regardless of whether the individual thread is being brought into the temporary storage means or not. Threads which are already arranged on the spindle 23 are, as a result, successively moved on the spindle away from its free end 23*b*.

By means of a suitable selection of the pitch of the spindle thread, a situation can also be reached in which the thread density of the thread layer 1 is formed on the spindle 23. In addition, the spindle 23, with each processed or temporarily-stored thread, should also be moved forwards in a translatory manner, step by step parallel to the plane of the thread layer in the operational direction 28 of the layer. In this situation, each of the advance steps can also accord with the density of the thread, i.e. with the reference interval between sequential threads of the warp thread layer 1. By means of this measure, it is possible to achieve the situation, in an especially simple manner, in which the tension of the threads located in the temporary storage means does not lead to any plastic deformation of the threads. For preference, the tension in the threads should remain at least approximately constant.

In addition, as represented in FIG. 4, by means of a temporary storage means arranged in each case on each side of the thread layer, the situation can also be achieved in which, with the temporary storage of one or more threads, no looping of a thread of the temporary storage means can occur with a thread which is still located in the thread layer. Looping or twisting imposes a particularly severe burden on the threads, and can lead to their tearing. Particularly critical are twists towards the warp beam, since such twists cannot be released again during the subsequent operating steps in connection with the drawing in of loom harness elements, at least not without manual intervention.

According to the invention it may therefore be preferable for the thread 2 acquired by the separating means 13 and deposited in the intermediate storage means, to be brought onto that spindle 22, 23, on the side of which this thread 2 crosses one or more other threads. Due to the sequence of the part layers to one another during the assembling of the thread layer, and the course of the layer separation bands 7, 8, connected as a result in the thread layer, it can be assumed from this that a thread can only cross a thread of another colour on a specific side of the thread layer. In order to prevent threads crossing a thread of another colour on the other side of the thread layer to this, before a start is made the thread separation bands 7, 8, can be drawn over the separation point which separates each of the part layers from the other part layers. As a result of this, only crossings remain in the area of the separating means 13 which can be released by the separation method according to the invention, which makes provision for the use of a temporary storage means.

With these measures a thread layer can be processed in a particularly favourable manner which exhibits two or more different thread types, for example threads 2-4 of different colours, without threads looping in the process.

Because sequential threads 2-4 of the same colour nevertheless always lie on the same side of the layer separation band, such threads which are to be temporarily stored are also conducted into the same storage means.

Sequential threads of different colours, and therefore also of different part layers, which are to be temporarily stored, should by contrast be transferred into different storage means in order to avoid twisting. In addition to this, it may be of advantage for the subsequent emptying of the storage means if a distance of at least one rotation of the spindle thread is established in the storage means between threads of different colours.

FIGS. 13*a* and 13*b* represent a section of such a warp thread layer, whereby in the representation of FIG. 13*a* the actual state is shown, and in FIG. 13*b* the reference state. The threads with the reference identifiers a, b, and c, d, have the same colour, such as green, for example. The threads e, f, can, by contrast, be white, and the threads g, h, blue. According to the reference state (warp thread repeat) of FIG. 13*b*, the thread sequence (in the representation of FIG. 13*b*, from right to left) is intended, however, to be a, b, c, d, e, f, g, h. From this it can be seen that in the actual state (FIG. 13*a*), the green threads c, d, as well as the white threads e, f, also cross the blue threads g, h.

In order to achieve the reference arrangement, the relative position of the green, white, and blue part layers to the other part layers in each case are to be taken into account. In FIG. 13*c*, for this purpose, the situation is shown which pertained at the assembling of the part layers to form the thread layer 1, and which is now to be taken into account with the introduction of a lease according to the invention. As FIG. 13*c* shows, three part layers are rolled onto a warp beam 45, whereby the first layer separation band 7 is introduced between the blue (threads g, h) and the green (threads a, b, c, d) part layer. The second layer separation band 8, by contrast, runs between the green (threads a, b, c, d) and the white (threads e, f) part layer.

These relative positions of the part layers obtained during the assembling in respect of one another, as well as, in particular, to the layer separation bands, should be taken into account when making decisions as to which temporary storage means the individual threads should be transferred. This means that a thread should always be transferred into the temporary storage means or storage means which corresponds to the position of the temporarily-stored thread in relation to the thread which is being sought according to the warp thread repeat. A thread from a part layer which, according to the warp thread repeat, is arranged above a thread of another part layer, should always be brought into the upper storage means. A thread of a part layer which, according to the warp thread repeat, is arranged underneath the part layer from which the next following "reference thread" is derived, is therefore to be transferred into the lower storage means. As a result of this, it is possible, in a particularly simple manner, to avoid thread twists.

In the embodiment according to FIGS. 13*a*-13*c*, the warp thread layer represented in sections is processed from left to right. To this end, the warp thread layer is tensioned between two tensioning points, whereby in FIGS. 13*a* and 13*b* only one tensioning point is shown. The suction nozzle 14 is used to separate the threads.

In accordance with the criterion given above, this means, for the embodiment in question, that first the two green threads d, c, are to be transferred one after another into the upper storage means. According to the warp thread repeat, a blue thread g, h, is expected; in fact, however, the separating means acquires a green thread. From FIG. 13*c* it can be seen that the green part layer (threads a, b, c, d) is arranged above the blue part layer (threads g, h). As a consequence, the green thread is transferred into the upper storage means. The same applies to the second green thread c, as a result of which there are now two green threads c, d, temporarily stored in the upper storage means.

Thereafter, the suction nozzle 14 acquires and transfers one after the other the two blue threads h, g, to the transfer means, as a result of which the threads h, g, are arranged on the leasing side, not shown in FIGS. 13*a*, 13*b*. Because the white threads f, e, are subsequently acquired in turn one after the other, which corresponds to the sequence of the threads specified by the warp thread repeat, they are also brought directly onto the leasing side and not into the temporary storage means. Because the warp thread repeat specifies two green threads as the next to be provided, the upper storage means can now be emptied, in that the first green thread c is first transferred out of the storage means into the warp thread layer and brought onto the leasing side. This process is then repeated with the second green thread d. It is also possible for the two threads c, d, to be drawn simultaneously out of the storage means. Following this, the two green threads b, a, can now also be brought onto the leasing side.

FIG. 14*a* shows a sectional representation of a further section of an actual state of a warp thread layer. FIG. 14*b*, by contrast, shows the reference state, and FIG. 14*c* the relative position of the part layers blue (threads g, h), green (threads a, b, c, d), and white (threads e, f) during the previous assembling process. With this embodiment, working from right to left, first the two green threads a, b, are to be brought into the upper storage means, and the two blue threads g, h, onto the leasing side. The two green threads c, d, would then actually have to be brought into the lower storage means, since the green part layer (threads a, b, c, d) is arranged beneath the white part layer (threads e, f). This could, however, lead to crossovers, since threads of the same part layer would then be arranged in the lower as well as in the upper storage means. A thread separated subsequently would then necessarily have to be "guided through" the green part layer.

In order to avoid this, provision is made first for the upper storage means with the green threads a, b, to be emptied. Accordingly, four green threads a-d are located foremost. These can then be brought one after another into the lower storage means. Thereupon, both the white threads e, f, which follow next both according to the reference state as well as according to the actual state obtained, are to be guided onto the leasing side. Thereafter the green threads a-d can again be drawn from the lower storage means and likewise brought onto the leasing side.

The invention claimed is:

1. A storage device comprising:

at least one storage means for temporarily storing at least one thread separated out of a thread layer formed from threads running essentially parallel to one another, wherein the at least one storage means includes at least one retaining means for retaining the at least one thread under tension, wherein the at least one retaining means is arranged outside a plane defined by the thread layer; and at least one transfer means for transferring the thread separated out of the thread layer to the storage means.

2. The storage device according to claim 1, further comprising a control device configured to compare a predetermined reference sequence of threads from the thread layer with an actual sequence of the threads, and, in the event of deviations between the reference sequence and the actual sequence, the control unit further being configured to activate the at least one transfer means to transfer the thread separated out of the thread layer to the at least one retaining means.

3. The storage device according to claim 1, wherein the at least one storage means includes a plurality of retaining means configured to allow simultaneous arrangement of several threads separated from one another in the storage means.

4. The storage device according to claim 3, wherein the storage means comprises a rotatable spindle including threaded outer surface defining several storage spaces.

5. The storage device according to claim 1, wherein the transfer means is configured to acquire the thread separated out of the thread layer at a separation point to transfer the thread to the storage means.

6. The storage device according to claim 1, wherein the the transfer means is configured to remove the thread from the storage means.

7. The storage device according to claim 1, wherein the at least one storage means comprises two storage means, wherein the two storage means are arranged on opposite sides of the thread layer from one another.

8. The storage device according to claim 7, wherein the two storage means are arranged in a mirror symmetrical pattern in relation to the plane defined by the thread layer.

9. The storage device according to claim 7, wherein the two storage means are configured to move synchronously with one another.

10. The storage device according to claim 1, further comprising a conveying stretch along which the thread separated out from the thread layer can be transferred to the storage means.

11. The storage device according to claim 1, further comprising a transfer element configured to transfer another thread separated from the thread layer onto a processing side of the thread layer, while or before the thread is transferred out of the storage means by the transfer means.

12. The storage device according to claim 11, wherein the transfer element is configured to transfer the other thread from the thread layer to the processing side without being transferred to or from the storage means.

13. A storage device comprising:

tensioning means for tensioning a plurality of threads aligned essentially parallel to one another to define a thread layer;

at least one storage means for temporarily storing at least one thread separated out of the thread layer, the at least one storage means includes at least one retaining means for retaining one or more of the plurality of threads, wherein the at least one storage means is arranged outside a plane defined by the thread layer, and wherein the storage means is configured to be rotated by a drive unit in two opposite directions of rotation about an axis.

14. The storage device according to claim 13, wherein the storage means is rotatable in a first direction of rotation about the axis for storing at least one thread on the storage means, and wherein the storage means is rotatable about the axis in the opposite direction for discharge of the thread from the storage means.

15. A device for the separation of individual threads from a thread layer tensioned between two tensioning points, comprising:

a separating means for separating at least one thread or several threads simultaneously out of the thread layer; and a storage means for temporarily storing the at least one thread separated out of the thread layer and including at least one retaining means for retaining the at least one thread separated out of the thread layer, wherein the at least one retaining means is arranged outside a plane defined by the thread layer.

16. The device according to claim 15, further comprising a detection device configured to detect properties of individual threads separated out of the thread layer.

17. The device according to claim 16, wherein the detection device is connected to a control device containing stored reference information about at least one property of threads, and wherein the control device is configured to compare the stored reference information with the properties detected by the detection device.

18. A warp thread drawing-in machine comprising:

a device for the separation of individual threads from a thread layer tensioned between two tensioning points, the device comprising a separating means for separating at least one thread or several threads simultaneously out of the thread layer; and a storage means for temporarily storing the at least one thread separated out of the thread layer and including at least one retaining means for retaining the at least one thread separated out of the thread layer, wherein the at least one retaining means is arranged outside a plane defined by the thread layer.

19. A leasing machine comprising:

means for tensioning a plurality of threads aligned essentially parallel to one another to define a thread layer;

means for separating at least one thread from the thread layer; and means for entering a lease into the thread layer including a storage device comprising at least one storage means for temporarily storing at least one thread separated out of the thread layer wherein the at least one storage means includes at least one retaining means for retaining the at least one thread, wherein the at least one retaining means is arranged outside a plane defined by the thread layer; and at least one transfer means for transferring the thread separated out of the thread layer to the storage means.

20. A method for separating at least one thread from a tensioned thread layer defined by a plurality of threads aligned essentially parallel to one another, the method comprising:

transferring at least one thread from the thread layer into a temporary storage means when a deviation from a predetermined sequence of threads in the thread layer is detected, and transferring the at least one thread from the temporary storage means back to the thread layer after at least one further thread has been separated from the thread layer.

21. The method according to claim 20, wherein the at least one thread is temporarily stored in a retaining means of the temporary storage means outside the thread layer.

22. The method according to claim 20, further comprising detecting an actual sequence of threads in the thread layer with a detection device; and comparing the predetermined sequence of threads with the actual sequence of threads, wherein in the event of deviations, a control device activates a transfer means to transfer a separated thread into the temporary storage means.

23. The method according to claim 20, wherein before the at least one transferred thread is transferred out from the temporary storage means, transferring a further thread into a second temporary storage means arranged on an opposite side of the thread layer from the temporary storage means.

24. The method according to claim 23, wherein the transferring of the further thread to the second temporary storage means rather than the temporary storage means is based on a predetermined layer stacking sequence of part layers of the thread layer.

25. The method according to claim 20, further comprising transferring several threads one after another in a specific sequence into at least the temporary storage means; and drawing the several threads off at least the temporary storage means one after another in the reverse sequence.

* * * * *